US006736356B1

(12) United States Patent
Murphy

(10) Patent No.: US 6,736,356 B1
(45) Date of Patent: May 18, 2004

(54) TOOTHBRUSH HOLDER ADAPTER

(76) Inventor: Thomas Murphy, 706 Green St., Haddon Heights, NJ (US) 08035

( * ) Notice: Subject to any disclaimer, the term of this patent is extended or adjusted under 35 U.S.C. 154(b) by 0 days.

(21) Appl. No.: 10/395,799

(22) Filed: Mar. 21, 2003

(51) Int. Cl.[7] ..... A46B 17/02
(52) U.S. Cl. ..... 248/112; 248/302
(58) Field of Search ..... 248/302, 303, 248/301, 305, 690, 112, 220.31; 211/65, 66

(56) References Cited

U.S. PATENT DOCUMENTS

| | | | | | |
|---|---|---|---|---|---|
| 1,487,085 | A | * | 3/1924 | Blackshear | 211/65 |
| 2,919,813 | A | * | 1/1960 | Clark | 211/65 |
| 3,085,716 | A | * | 4/1963 | Trattler | 222/93 |
| 3,709,452 | A | * | 1/1973 | Feeny | 248/220.42 |
| 4,779,829 | A | * | 10/1988 | Rocke et al. | 248/206.2 |
| 5,026,011 | A | * | 6/1991 | Hoefkes | 248/220.41 |
| 5,054,728 | A | * | 10/1991 | Nigro, Jr. | 248/220.41 |
| 5,921,407 | A | * | 7/1999 | Kabanek | 211/65 |
| 5,927,517 | A | * | 7/1999 | Lipman et al. | 211/59.1 |
| 6,330,948 | B1 | * | 12/2001 | Leto | 211/70.6 |
| 6,457,592 | B1 | * | 10/2002 | Rozen | 211/65 |

FOREIGN PATENT DOCUMENTS

| | | | | |
|---|---|---|---|---|
| JP | 09103354 | A | * 4/1997 | A47G/25/24 |

* cited by examiner

*Primary Examiner*—Leslie A. Braun
*Assistant Examiner*—A. Joseph Wujciak
(74) *Attorney, Agent, or Firm*—Stuart M. Goldstein

(57) ABSTRACT

A toothbrush holder adapter is provided which consists of an integral, unitary component with a toothbrush receiving section and a rear section adapted to be inserted into the holes or openings in a wall-mounted toothbrush holder. The receiving section of the member comprises dual side members forming a tapered opening into which a toothbrush is inserted and retained below its brush head. The dual side members merge to form the rear section, an extension portion which is insertable into an opening in the holder. The adapter is entirely coated with rubberized or plastic-type coating to assist in gripping the surfaces of the holder and the toothbrush handle, and in maintaining the adapter securely in the holder when a toothbrush is positioned in it. In an alternate configuration the extension portion of the adapter can be secured to a suction cup, in order to allow the adapter to support a toothbrush on a substantially vertical surface, such as a mirror or tile wall.

15 Claims, 4 Drawing Sheets

TOOTHBRUSH HOLDER ADAPTER

BACKGROUND OF THE INVENTION

The handles of many toothbrushes today are of such varied shapes, designs and sizes that they very often cannot fit into the standard wall-mounted toothbrush holders found in many bathrooms. This type of holder comprises a hole or similar opening which is usually oval in shape to hold the toothbrush at and under its brush head. Although toothbrush manufacturers still make a small percentage of toothbrushes which fit, this holder cannot accept the majority of toothbrushes on the market. Toothbrushes today are designed with large and ergonomically correct handles to fit the hand for comfort and grip. Many children's toothbrushes are designed in the shape of cartoon or other fictional characters and many of these also have larger handles. Toothbrush heads are also designed with many different styles and are positioned at different angles.

Toothbrushes that have handles too large to be placed into the holes of the holders from above, can sometimes be inserted brush head first from underneath the holder. However, this forces the brush head to contact the inside of the hole—causing potential damage to the bristles of the brush head and risking germ contamination as the toothbrush is continuously taken in and out of the holder.

Toothbrushes which cannot fit in holders are usually placed on a countertop or adjacent to a sink or put in a medicine cabinet. By not being placed in a holder, which allows a toothbrush to dry, the brush is subject to further cross-contamination of germs from sink activity.

There have been relatively few devices which have addressed these problems. For instance, U.S. Pat. No. 6,457,592 employs the use of an attachment piece which must be secured by screws to the holder. Further, the toothbrush handle receiving aperture is one uniform size, thus limiting the types of handle which can be used.

SUMMARY OF THE INVENTION

It is thus the object of the present invention to provide a toothbrush holder adapter which overcomes the significant limitations and disadvantages of prior devices.

It is an object of the present invention to provide a toothbrush holder adapter which will accept virtually all toothbrush handles, regardless of design, shape, or size.

It is a further object of the present invention to provide a toothbrush holder adapter which is easily, simply, and quickly installed for use in a wall-mounted toothbrush holder and retained in the holder without the need for any attachment instrumentalities.

It is another object of the present invention to provide a toothbrush holder adapter which will be securely maintained within a wall-mounted toothbrush holder when a toothbrush is placed therein.

It is a further object of the present invention to provide a toothbrush holder adapter which can be mounted directly to a substantially vertical surface to accept virtually all toothbrush handles, regardless of design, shape or size.

It is another object of the present invention to provide a toothbrush holder adapter which is formed and constructed to grip both the surface of a toothbrush holder and the surface of the brush.

These and other objects are accomplished by the toothbrush holder adapter of the present invention which consists of an integral, unitary component with a toothbrush receiving section and a rear section adapted to be inserted into the holes or openings in a wall-mounted toothbrush holder. The receiving section of the member comprises dual side members forming a tapered opening into which a toothbrush is inserted and retained below its brush head. The dual side members merge to form the rear section, an extension portion which is insertable into an opening in the holder. The adapter is entirely coated with soft plastic or rubber type coating to assist in gripping the surfaces of the holder and the toothbrush handle, and in maintaining the adapter securely in the holder when a toothbrush is positioned in it. In an alternate configuration the extension portion of the adapter can be secured to a suction cup, in order to allow the adapter to support a toothbrush on a substantially vertical surface, such as a mirror or tile wall.

Certain novel features and components of this invention are disclosed in detail in order to make the invention clear in at least one form thereof However, it is to be clearly understood that the invention as disclosed is not necessarily limited to the exact form and details as disclosed, since it is apparent that various modifications and changes may be made without departing from the spirit of the invention.

DETAILED DESCRIPTION OF THE DRAWINGS

DETAILED DESCRIPTION OF THE INVENTION

Figure 6:
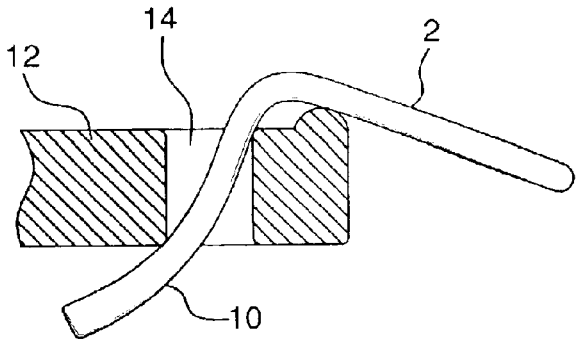
FIG. 6 is a cross-sectional view of the toothbrush adapter of the present invention in use in a toothbrush holder.
Figure 7:
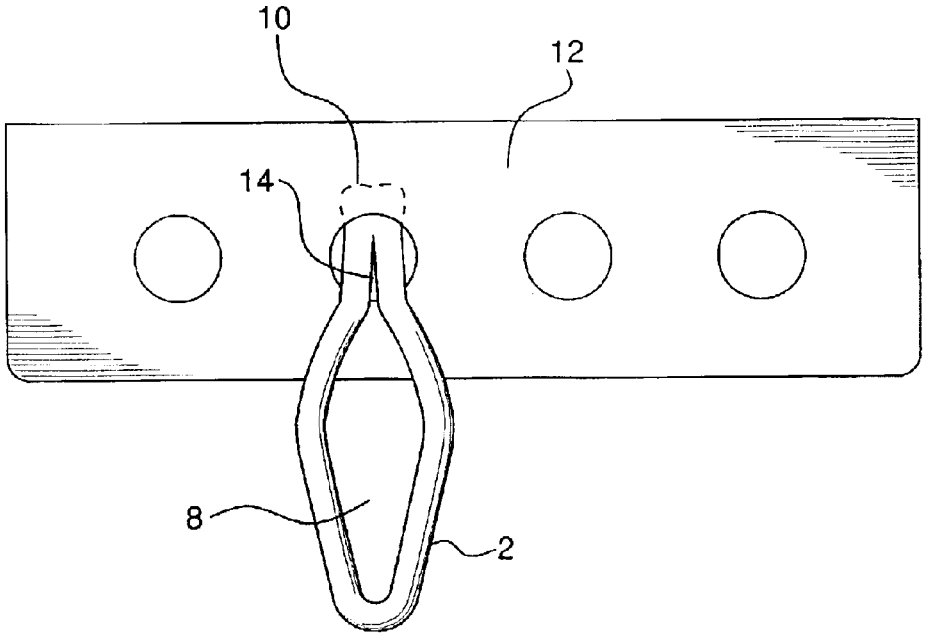
FIG. 7 is a top view of the toothbrush holder adapter of the present invention in use in a toothbrush holder.

Toothbrush holder adapter 1 is an integral, unitary component. Optimally, its core is made of bendable metal or similar material, although the manner and material of construction and fabrication is not to be considered restrictive of the scope of the invention. Adapter 1 comprises section 2 with lateral side members 4 and 6 forming tapered opening 8. Opening 8 narrows at inboard distal end 7 and outboard distal end 9. Members 4 and 6 of section 2 smoothly merge to form rear section 10. Section 10 is the extension portion of adapter 1 whose ends curve slightly upward. See FIG. 6.

Figure 1:
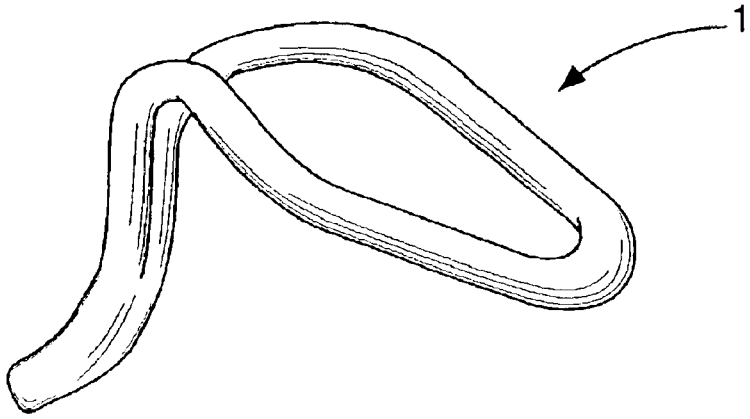
FIG. 1 is a perspective view of the toothbrush holder adapter of the present invention.
Figure 2:
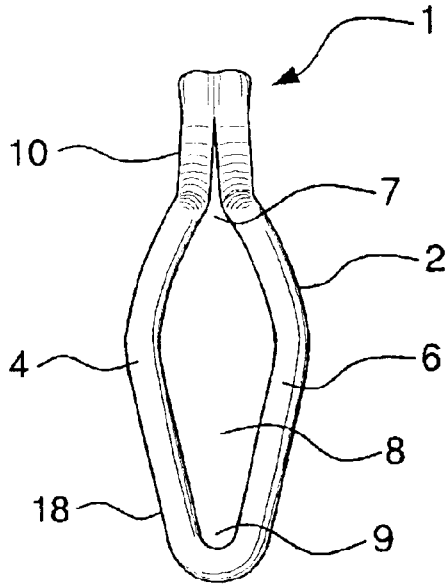
FIG. 2 is a top view of the toothbrush holder adapter of the present invention.
Figure 3:
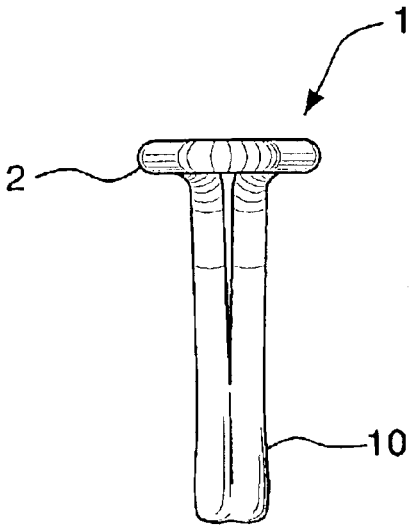
FIG. 3 is a front view of the toothbrush holder adapter of the present invention.
Figure 4:
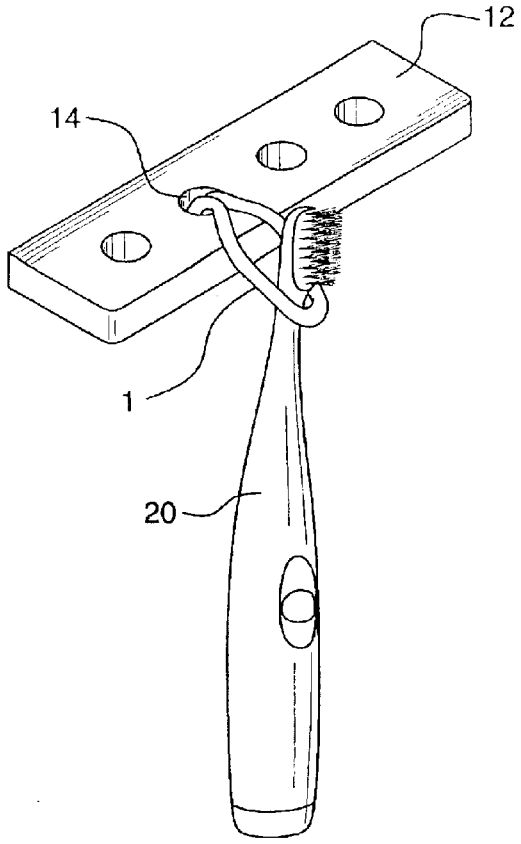
FIG. 4 shows the toothbrush holder adapter of the present invention in use.

In use with a wall-mounted toothbrush holder 12, section 10 of adapter 1 is simply inserted into one of the holes or openings 14 of the holder, such that section 2 overlays and extends over the upper surface of the holder. Toothbrush 20 is inserted under or over and through opening 8 of section 2, and retained therein under its brush section, at outboard distal end 9, as best seen in FIG. 4. It can be appreciated that the tapered nature of opening 8 will allow toothbrush handles of a multitude of sizes, shapes and designs to be inserted into and retained by the adapter. When toothbrush 20 is positioned in adapter 1, as shown in FIG. 4, the toothbrush itself, positioned within opening 8, provides a type of counterweight downward, which forces section 10 upward within hole 14. See FIG. 6. This serves to maintain and secure adapter 1 in holder 12 for as long as toothbrush is positioned in opening 8. No attachment device or other attachment instrumentality is required to maintain adapter 1 in hole 14, whether a toothbrush is in position or a whether it has been removed. Adapter 1 can be easily removed and repositioned in another hole by simply removing toothbrush 20 from opening 8 and lifting the adapter out of hole 14.

Figure 5:
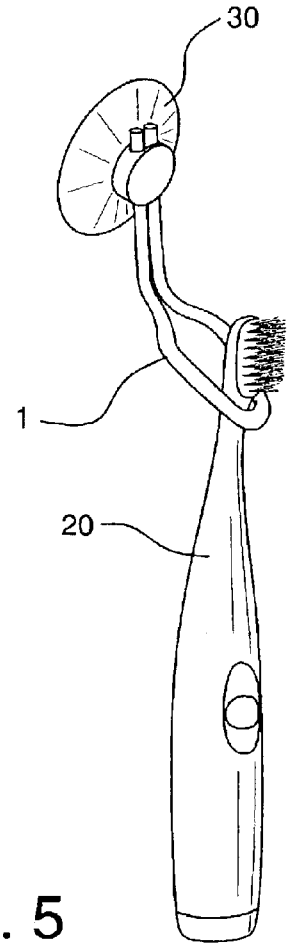
FIG. 5 shows an alternative embodiment of the toothbrush holder adapter of the present invention.

Adapter 1 can also be used in combination with suction cup 30, to position a toothbrush on a substantially vertical tile wall, mirrored, or similar surface. As shown in FIG. 5, the end of section 10 of adapter 1 is secured within suction cup 30, which is to be positioned on a vertical surface. In this configuration, toothbrush 20, which can still have a multitude of handle sizes, shapes and designs, is positioned and maintained on a vertical surface.

Adapter 1 optimally is encased in a soft rubberized or plastic coating 18, for instance polyisopeme, which assists in gripping the smooth ceramic surfaces of which the toothbrush wall-mounted holders are often made. Coating 18 also aids in gripping the smooth plastic of toothbrush handles.

The novel features which are considered as characteristic of the invention are set forth in particular in the appended claims. The toothbrush holder adapter, itself, however, both as to its design, construction, and use, together with additional features and advantages thereof are best understood upon review of the following detailed description with reference to the accompanying drawings.

I claim:

1. A toothbrush holder adapter for use with a wall-mounted toothbrush holder having a plurality of holes, said adapter being an integral, unitary member comprising:

(a) first section means for insertion into one of the holes, said first section means comprising a single member, downwardly sloped towards one of the holes, whereby said first section, when inserted within a hole, is positioned and remains therein independently of any other attachment instrumentality; and (b) second section means for receiving the handle of a single toothbrush and for retaining the toothbrush therein, said second section means comprising enclosed opening means for receiving a toothbrush which fits within the holes and for receiving a toothbrush which is too large to fit within the holes, said second section means further comprising a tapered opening which narrows at inboard and outboard distal ends of the second section means, such that the toothbrush is retained within the second section means at the outboard distal end of the second section means and, whereby placement of the toothbrush within the second section means maintains the adapter within the hole independently of any other attachment instrumentality.

2. The toothbrush adapter as in claim 1 wherein the first section means merges smoothly into the second section means.

3. The toothbrush holder adapter as in claim 1 wherein the first section means and the second section means are covered in coating means for gripping the surfaces of the toothbrush holder and the toothbrush.

4. The toothbrush holder adapter as in claim 1 whereby the adapter is separable from the toothbrush holder solely by removing the first section means from the hole.

5. A toothbrush holder adapter for use with a wall-mounted toothbrush holder having a plurality of holes, said adapter being integral and unitary and comprising dual side members forming tapered opening means for receiving the toothbrush and for retaining the toothbrush in the adapter, tapered opening means comprising inboard and outboard distal ends, the opening means narrowing at these distal ends, wherein the toothbrush is retained within the tapered opening means at the outboard distal end of the tapered opening means; said adapter further comprising an adapter support section extending from the side members for insertion into a hole of the toothbrush holder.

6. The toothbrush holder adapter as in claim 5 wherein insertion of the adapter support section into a hole maintains the adapter within the opening independently of any other attachment instrumentality.

7. The toothbrush holder adapter as in claim 5 wherein the dual side members merge smoothly into the adapter support section.

8. The toothbrush holder adapter as in claim 5 wherein the tapered opening means is configured to receive toothbrushes which both fit within the holes and for receiving toothbrushes which are too large to fit into the holes.

9. The toothbrush holder adapter as in claim 5 wherein the dual side members and the adapter support section are covered in coating means for gripping the surfaces of the toothbrush holder.

10. The toothbrush holder adapter as in claim 5 whereby the adapter is separable from the toothbrush holder solely by removing the adapter support section from the hole.

11. The toothbrush holder adapter as in claim 5 wherein the adapter support section is curved upwards.

12. A toothbrush holder adapter for use on a substantially vertical surface, said adapter being an integral and unitary component comprising dual side members forming tapered opening means for receiving the toothbrush and for retaining the toothbrush in the adapter, the tapered opening means comprising inboard and outboard distal ends, the opening means narrowing at these distal ends, wherein the toothbrush is retained within the tapered opening at the outboard distal end of the opening means; said adapter further comprising an adapter support section extending from the side members, said adapter support section being connected to means to secure the adapter to the surface.

13. The toothbrush holder adapter as in claim 12 wherein the dual side members merge smoothly into the adapter support section.

14. The toothbrush holder adapter as in claim 12 wherein the dual side members and the adapter support section are covered in coating means for gripping the surfaces of the toothbrush handle.

15. The toothbrush holder adapter as in claim 12 wherein the means to secure the adapter comprises a suction cup.

* * * * *